US007159759B2

(12) United States Patent
Sutherland

(10) Patent No.: US 7,159,759 B2
(45) Date of Patent: Jan. 9, 2007

(54) FULLY ENCLOSED WRAP-AROUND CARTON

(75) Inventor: Robert L. Sutherland, Kennesaw, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 233 days.

(21) Appl. No.: 10/860,502

(22) Filed: Jun. 3, 2004

(65) Prior Publication Data

US 2005/0269387 A1 Dec. 8, 2005

(51) Int. Cl.
*B65D 65/22* (2006.01)
*B65D 65/12* (2006.01)
*B65D 71/36* (2006.01)

(52) U.S. Cl. ..... 229/103.2; 206/427

(58) Field of Classification Search ..... 229/103.2; 206/140, 141, 427; 53/48.6, 48.7, 48.8, 48.9
See application file for complete search history.

(56) References Cited

U.S. PATENT DOCUMENTS 3,127,720 A * 4/1964 Garrard et al. ..... 53/48.7
3,128,010 A 4/1964 Forrer
3,640,448 A * 2/1972 Wood ..... 206/158
4,010,593 A 3/1977 Graham
4,237,673 A * 12/1980 Calvert et al. ..... 53/48.9
4,382,505 A * 5/1983 Sutherland et al. ..... 206/427
4,440,340 A * 4/1984 Bakx ..... 206/140
4,588,084 A * 5/1986 Holley, Jr. ..... 206/427
4,925,019 A * 5/1990 Ganz et al. ..... 206/427
5,197,598 A * 3/1993 Stout et al. ..... 206/141
5,551,556 A * 9/1996 Sutherland ..... 206/427
6,112,977 A 9/2000 Sutherland et al.
6,758,337 B1 7/2004 Chargueraud et al.
2004/0000494 A1 1/2004 Sutherland

FOREIGN PATENT DOCUMENTS

EP 0 276 671 A1 8/1988
WO WO 2004/113182 A1 12/2004

* cited by examiner

*Primary Examiner*—Gary E. Elkins
(74) *Attorney, Agent, or Firm*—Womble Carlyle Sandridge & Rice, PLLC

(57) ABSTRACT

A fully enclosed pack is provided with a gusset that is capable of being formed from a blank without the use of tucker fingers. Nicks are provided between the side end panel and tuck-in panels of the carton. As the side end panels are folded, the nicks help pull the tuck-in panels inwardly to allow the gusset of the carton to take form without the use of tucker fingers in a folding/gluing operation.

17 Claims, 5 Drawing Sheets

FULLY ENCLOSED WRAP-AROUND CARTON

FIELD OF THE INVENTION

The present invention relates to fully enclosed pack carriers that are constructed from blanks by folding and gluing and that provide full protection for containers held therein. A small nick is provided in the blank between each gusset panel and each adjoining door panel to tuck the end flap portions into proper position during the folding and gluing operation without requiring the use of tucker fingers.

BACKGROUND OF THE INVENTION

Fully enclosed cartons that provide protection for the containers housed therein are known in the art. These fully enclosed containers usually are formed from a blank into a carton by a folding/gluing machine that utilizes a forming means, e.g. blades, fingers, or wheels, capable of tucking the sides of a carton inward to ensure that all panels are in the proper position. The carton is folded and glued along the side, top, or bottom panels, is filled with product containers, and proceeds to a folding/gluing operation in the machine. The carton pack is then turned 90° and the side doors of each carton end are closed. The top panel is then railed or forced downward and is glued to the side doors.

Generally, conventional folding machines include longitudinally spaced tucker fingers that act to fold the end flaps during the formation process. These tucker fingers push the door panels together after the carton has been oriented into a specific position. For the tucker fingers to operate, the pack must be turned 90° to close the door panels to form the gusset. The inclusion and operation of tucker fingers along a folding path requires enough space and machinery to perform the 90° turn before folding to allow movement clearance of the tucker fingers. If a folding machine did not require such tucker fingers, the tucking operation could be performed more efficiently with less machine equipment and in less space than conventionally required.

SUMMARY OF THE INVENTION

A fully enclosed pack is provided that is capable of forming the gusset through the use of specifically placed nicks between each tuck-in panel and each door panel. These nicks will negate the conventional requirement of tucker fingers in the folding machine.

The blank used to form the present pack includes a top gusset, side door panels, and locking bottom panels. The top gusset web is scored generally with a long knife cut and is provided with a stripped out area to relieve the downward force of the web scores during folding. The side doors of the blank have a nick in each gusset panel corner. As the door panels are closed, the nick will help to pull the tuck-in panels inward. The inward pull of the tuck-in panels allows the gusset to take form without requiring the use of tucker fingers to form the gusset. A method for folding and gluing these packs using the nicks has also been described herein.

The nicks of the present blank are able to ensure proper orientation of all end panels during the folding/gluing operation through the pulling action of the tuck-in panels inward. The gusset panels are pulled inward by the nicks formed between the tuck-in panels and door panels.

Since the machine does not require the typical tucking fingers or other tucking means, a savings of equipment, room, and energy will be realized by the present carton. The pressure necessary to tuck the tuck-in panel inward is relatively slight and can be realized by the closing of the side end or door panels. Once the tuck-in panel has been tucked inward, the machine typically will apply glue (usually by raising the top end panel flaps enough to receive glue or other adhesive) and then plow or otherwise close the top end panel onto the door panels in order to close each carton end.

A wrap-around, fully enclosed carton for carrying bottles is thus disclosed that includes a top panel connected to sloping upper side panels, which are connected to lower side panels, which are connected to bottom panels. The carton has side end panels connected to each side of each lower side panel and top end panels connected to each side of the top panel. The bottom panels are capable of being folded into a closed position. The top end panel is capable of being closed by a two-piece web connected by fold lines. The web is connected to each respective sloping upper side panel and side end panel. The web includes a tuck-in panel, a gusset panel, and a nick formed between each said tuck-in panel and each said side end panel. The nicks are capable of pulling the tuck-in panels inward during formation of the carton.

A method of forming a wrap-around, fully enclosed carton from a blank is also disclosed. The method includes the steps of: securing the bottom panels together to form a sleeve around the bottles, closing the side end panels with the nicks pulling the gusset panels inwardly, and securing the top end panels to the side end panels.

These and other objects, features, and advantages of the present invention will become more apparent upon reading the following specification in conjunction with the accompanying drawing figures.

DETAILED DESCRIPTION OF THE PREFERRED EMBODIMENTS

Figure 2:
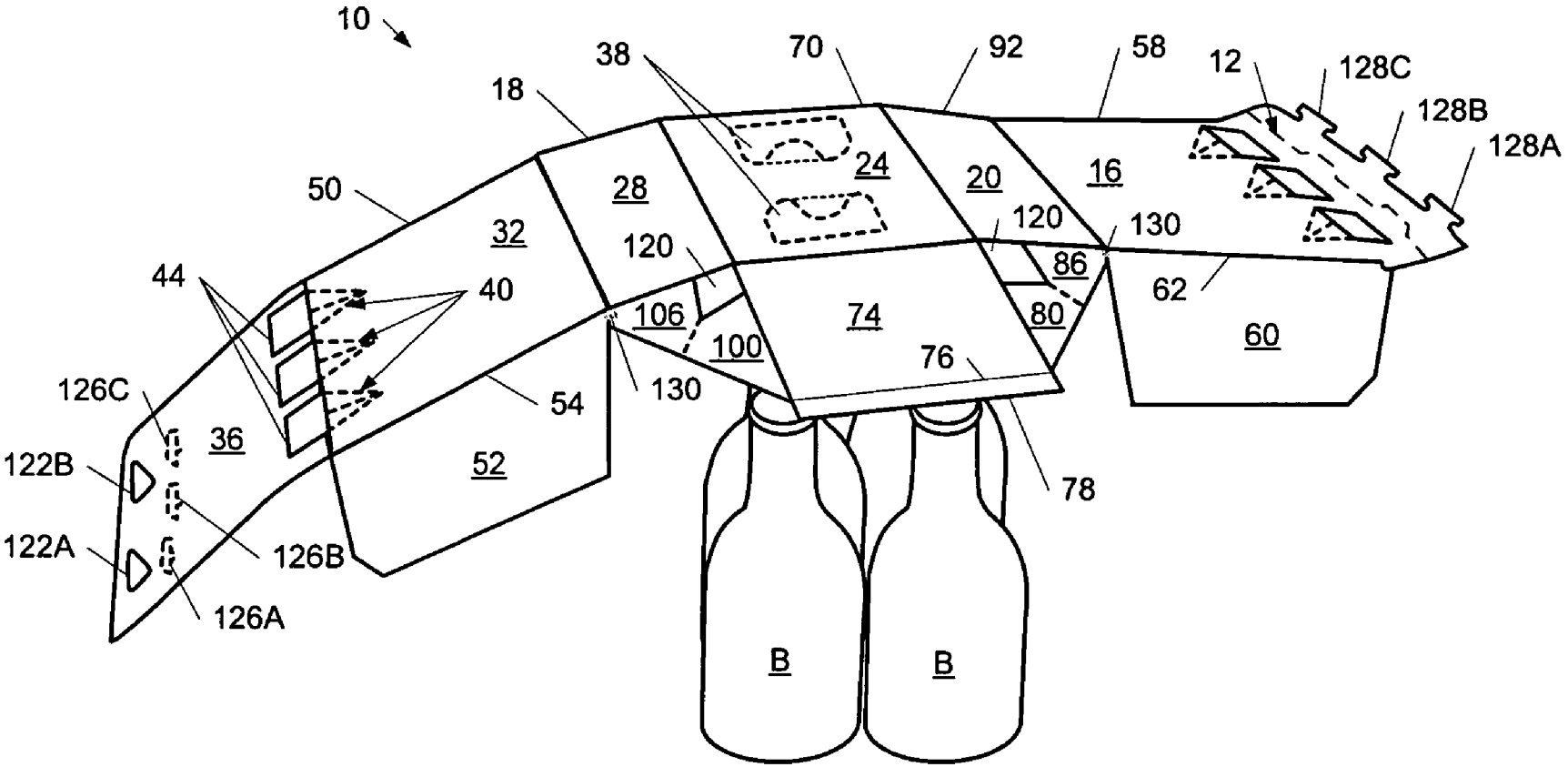
FIG. 2 is a perspective view of the blank of FIG. 1 over a group of six bottles.

The present invention is intended primarily for use with wrap cartons containing bottles or containers of the type used to contain soft drinks, beer, and the like. A typical example of such a bottle has a generally cylindrical body with an upper portion and a bottom, tapering shoulder, which is continuous with the upper portion of the body. A neck typically is formed on the shoulder with a smaller diameter than the body. The conventional bottle B is shown in FIG. 2 with a neck flange projecting outwardly from the neck and a cap attached to the upper end of the neck flange.

Figure 1:
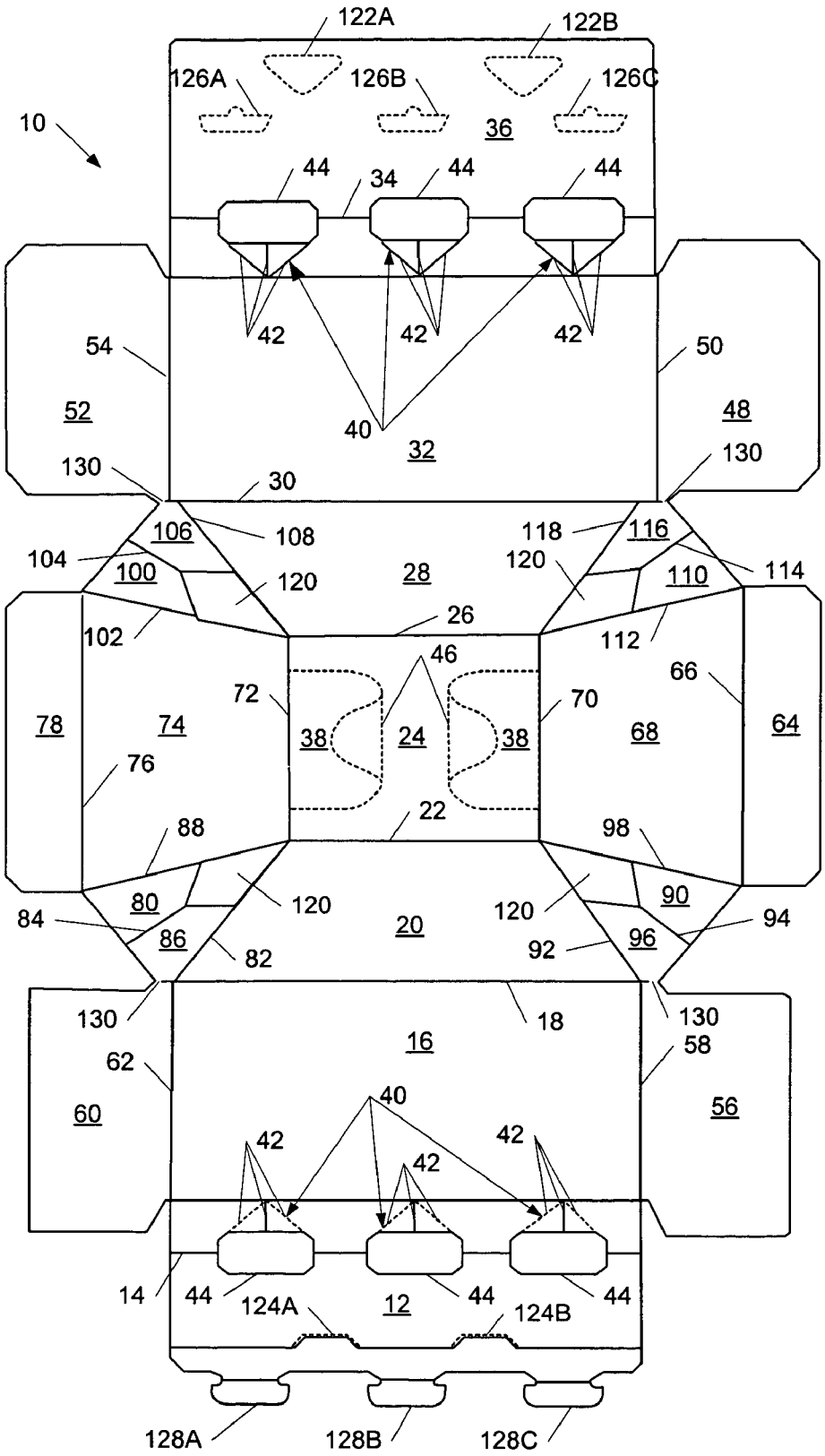
FIG. 1 is a plan view of the blank for forming the fully enclosed pack of this invention.

The blank 10 for forming the carton of the present invention is shown in FIG. 1. The blank 10 in this embodiment is proportioned to contain six bottles B in two rows of three each as shown in FIG. 2, but could be sized to contain any desired number and arrangement of bottles or other product containers. The blank 10 generally is formed from a foldable sheet material, such as paperboard. Blank 10 has a primary lock panel 12 that is foldably connected to lower side panel 16 by a fold line 14, which, in turn, is connected to sloping upper side panel 20 by fold line 18. Sloping upward side panel 20 is connected to a top panel 24 by fold line 22, which, in turn, is connected to sloping upper side panel 28 by fold line 26. Sloping upper side panel 28 is connected to lower side panel 32 by fold line 30, which, in turn, is connected to bottom panel 36 by fold line 34.

As shown in FIG. 1, the blank 10 is formed symmetrical about a horizontal line of bisection, which aids in the efficient production of the present carton. However, the carton need not have such symmetry. The blank 10 is rectangular with straight edges, which allow for efficient layout of blanks on a paperboard web from which the blanks are cut. The blank 10 has finger holes 38 formed in the top panels for convenience in carrying a filled carton. These finger holes 38 are shown as voids or openings in the blank capable of receiving a person's fingers for carrying the carton, but could be formed as finger flaps detachable along tear lines to allow removal of the finger flaps from, or depression into, the top panel. The finger holes 38 can include adjacent fold lines 46 to enable part of top panel 24 to be folded inwardly for further ease and comfort of carrying.

The bottles B typically are restrained from movement within the carton by the inclusion of heel retaining assemblies 40 or other suitable restraining means. These heel retaining assemblies 40 permit the carton to be tightly locked with a portion of the heel of each bottle B extending through a heel aperture 44 formed in each heel retaining assembly 40. Slits or fold lines 42 can be formed in lower side panels 16 and 32 to permit the tightening of the carton and to prevent the heel apertures 44 from being torn.

Since the blank 10 herein forms a fully enclosed wrap around carton, the ends of the carton are also closed. Accordingly, side end panel 48 is connected to lower side panel 32 by fold line 50 and side end panel 52 is connected to lower side panel 32 by fold line 54. Side end panel 56 is connected to lower side panel 16 by fold line 58 and side end panel 60 is connected to lower side panel 16 by fold line 62. The top ends of the carton are closed by top end panel 68, which is connected to top panel 24 by fold line 70. Top end panel 74 is connected to top panel 24 by fold line 72. The top end panels 68 and 74 also have flaps attached thereto to provide additional support for the side end panels 48, 52, 56, 60 when the carton is formed. Thus, top end panel flap 64 is connected to top end panel 68 by fold line 66 and top end panel flap 78 is connected to top end panel 74 by fold line 76.

When the blank 10 is formed into a carton with the top end panels folded downwardly about the bottles B, the top end panel flaps 64 and 78 act to reinforce the side end panels 48, 56 and side end panels 52, 60, respectively. The top end panel flaps 64 and 78 are capable of receiving glue or other adhesive and fold about respective fold lines 66 and 76 to adhere to respective side end panels to ensure a secure, fully enclosed carton. Each top end panel is connected to its adjacent side end panels by webbing, which facilitates holding the top end panels 68 and 74 and side end panels 48, 52, 56, and 60 in position after wrapping the carton around the group of bottles.

In order to form the blank 10 into a carton, gusset and tuck-in panels are included between the top end panels 68 and 74 and the sloping upper side panels 20 and 28. The gusset panels (also known as add panels) and tuck-in panels form the gusset of the carton. Tuck-in panel 86 is connected to sloping upper side panel 20 by a fold line 82 and is connected to a gusset panel 80 by a fold line 84. The gusset panel 80 is connected to top end panel 74 by a fold line 88. Tuck-in panel 96 is connected to sloping upper side panel 20 by a fold line 92 and, in turn, is connected to a gusset panel 90 by a fold line 94. Gusset panel 90 is connected to top end panel 68 by fold line 98. Tuck-in panel 106 is connected to sloping upper side panel 28 by a fold line 108 and is connected to a gusset panel 100 by fold line 104. Gusset panel 100 is connected to top end panel 74 by fold line 102. Tuck-in panel 116 is connected to sloping upper side panel 28 by fold line 118 and is connected to gusset panel 110 by fold line 114. Gusset panel 110 is connected to top end panel 68 by a fold line 112.

Where tuck-in panels 86, 96, 106, and 116 are attached to respective side end panels 60, 56, 52, and 48, a nick 130 is provided. As will be described further herein, as each side end panel is folded inward, the nick 130 will act to pull the respective tuck-in panel inward to form the gusset without the use of tucker fingers in the folding machine.

The carton of this invention may be glued together and/or may utilize a conventional locking system. In the embodiment shown in FIGS. 1–4, a locking system is provided that includes both a primary locking system and a secondary locking system. The primary locking system is the locking arrangement between primary male locks 124A–B in primary lock panel 12 and primary female openings 122A–B in bottom panel 36. The primary male locks 124A–B are hooked over the ledges of the primary female openings 122A–B during the locking of the carton. These primary locks act as the main securing feature and connect the ends of the carton together with flaps to tighten the carton tightly about the bottles B.

The secondary locking system shown includes secondary male locks 128A–C formed as an extension of primary lock panel 12 and secondary female openings 126A–C formed in bottom panel 36. These secondary locks are provided in addition to the primary locks to ensure the carton remains locked.

Other locking systems may be used for this carton, including any number or arrangement of male locks and female openings. In addition, the carton may be secured together by glue, tape, or any other adhesive that will close and hold the fully enclosed carton securely in place.

As shown in FIG. 2, the carton of this embodiment is formed from the blank 10 of FIG. 1 by moving the top panel 24 of the blank 10 over the top of a group of bottles B. The top end panels 68 and 74 are then folded downwardly over the bottles by a wrap machine.

Figure 3:
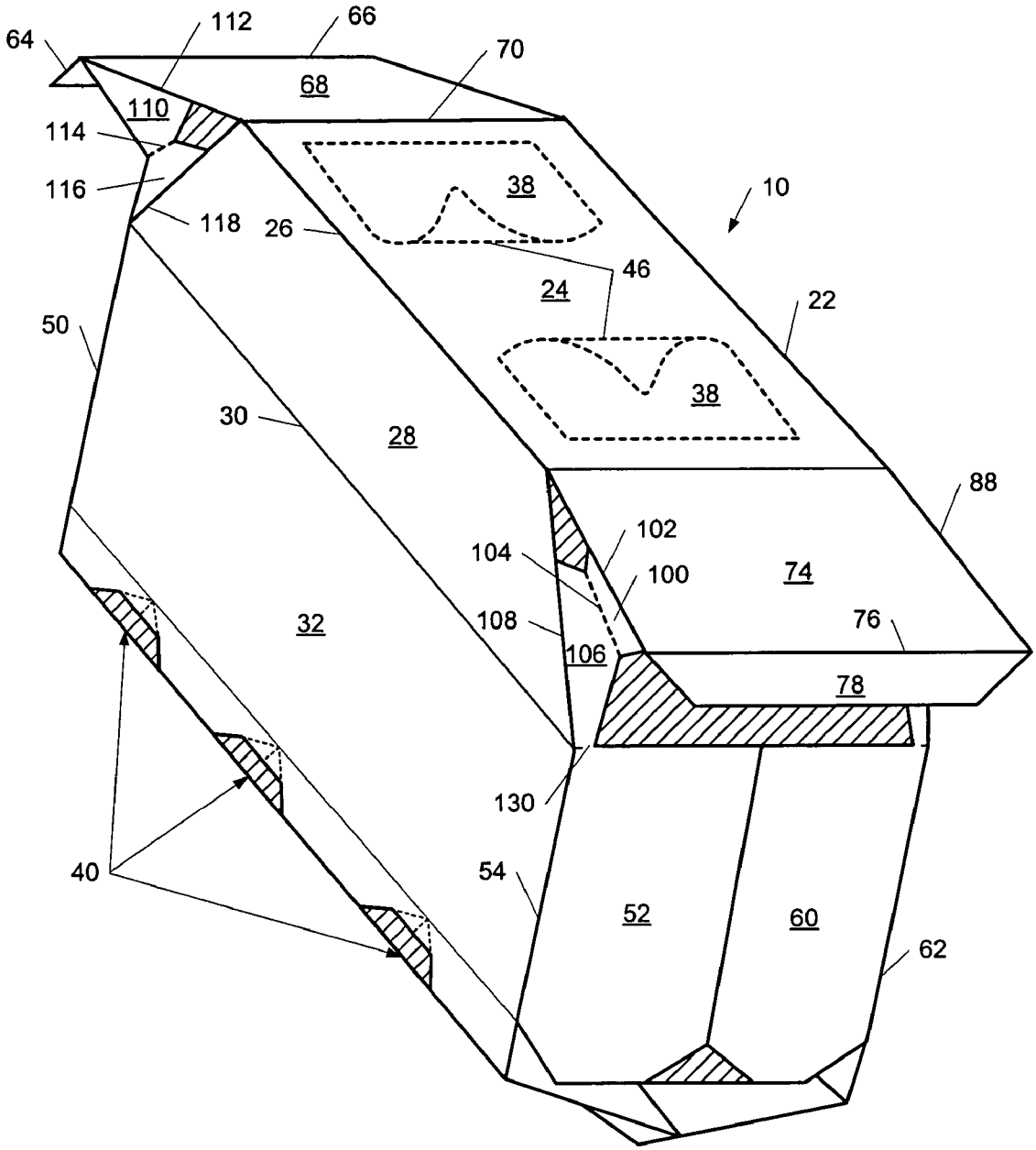
FIG. 3 is a perspective view of the side end panel doors pulling the tuck-in panels inward.
Figure 4:
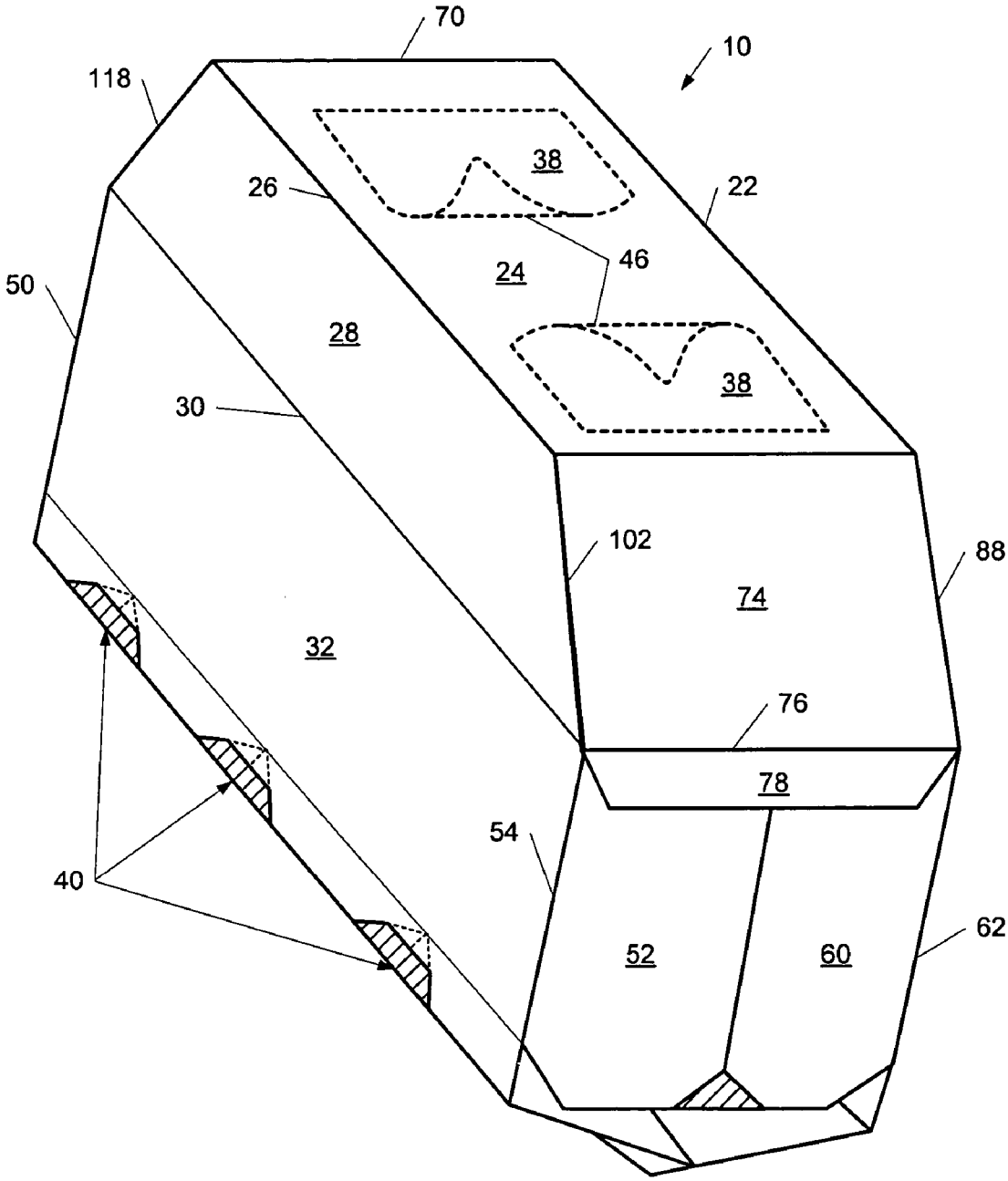
FIG. 4 is a perspective view of on end of the carton fully wrapped around the group of bottles of FIG. 2.

FIG. 3 shows a perspective view of the side end panel doors pulling the tuck-in panels inward. In prior art cartons, the wrap machine included tucker fingers used to push in the tuck-in panels 86, 96, 106, and 116 during folding. However, in the present carton, nicks 130 are provided between the tuck-in panels and side end panels, which allow the present carton to be closed by moving the side end panels 48, 52, 56, and 60 inwardly. The side end panels then pull the tuck-in panels 86, 96, 106, and 116 inward. This pulling inward of the tuck-in panels 86, 96, 106, and 116 allows the gusset to take form without requiring tucker fingers in the folding machine. Thus, the nicks 130 pull the tuck-in panels inwardly enough to allow gusset panels 80, 90, 100, and 110 to tuck inward when the top end panels 68 and 74 are closed to form an enclosed carton as shown in FIG. 4. The present blank is thus formed into a carton without the use of tucker fingers.

Figure 5:
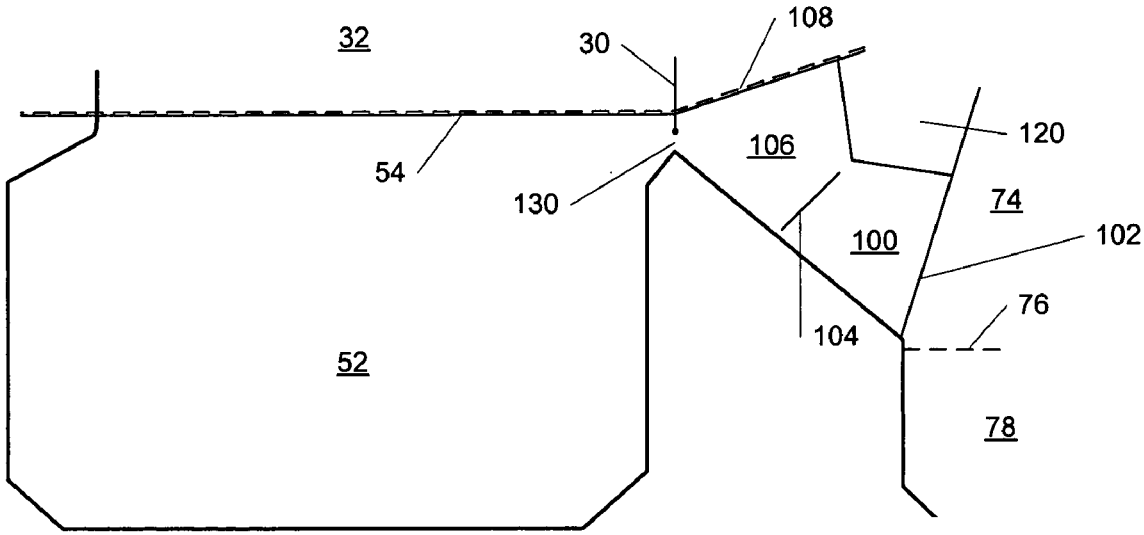
FIG. 5 is an enlarged view of a nick between a side end panel and tuck-in panel.

As shown in an enlarged view in FIG. 5, the nicks 130 included in the blank 10 generally are formed as spaces between the fold line and the outer periphery of the blank 10.

The nicks 130 typically are formed in 1.5 to 3 millimeter segments, but could be any length that performs the functions detailed herein. The nicks act to pull the gusset panels inward because of their attachment to the door and gusset panels.

Apertures or openings 120 may also be provided between the tuck-in panels, gusset panels, top end panels, and sloping upper side panels to facilitate folding of the webbing. The sloping upper side panels 20 and 28 are pushed downwardly as illustrated in FIG. 3. The primary lock panel 12 and the bottom panel 36 are folded upwardly against the bottoms of the bottles B and are locked. Compression fingers are inserted through the heel apertures 44 to tighten the carton for locking. The secondary male locks 128A–C are pushed inwardly into secondary female openings 126A–C. The primary male locks 124A–B are pushed inwardly into primary female openings 122A–B. The secondary lock system ensures that the primary lock system does not unlock.

A conventional wrap machine can be used to form the blank 10 into a fully enclosed carton, but will not require the use of tucker fingers to close the carton ends. The removal of the necessity of tucker fingers will result in a substantial savings of room, equipment, and time and will eliminate a conventional step in the folding and gluing process.

The fully enclosed carton described herein is constructed with the webbing between the bottom panel and top panel folded tightly inward against the bottles. Primary lock panel 12 and bottom panel 36 overlap each other and help facilitate holding the blank in position against the bottles. The webbing between the bottom panel, primary lock panel, and top end panel is secured by including gusset panels, tuck-in panels, and side end panels to hold the sloping upper side panels and lower side panels tightly against the bottles.

Although the dimensions and geometry of the various panels described herein can be modified depending on the size and shape of the bottles or containers to be contained in the carton, it is critical to ensure that the formation of the panels allows a tight enough fit for the carton around the bottles to secure the bottles within a fully enclosed carton.

While the invention has been disclosed in its preferred forms, it will be apparent to those skilled in the art that many modifications, additions, and deletions can be made therein without departing from the spirit and scope of the invention and its equivalents as set forth in the following claims.

What is claimed:

1. A method of forming a wrap-around, fully enclosed carton, wherein the carton includes a top panel connected to sloping upper side panels, which are connected to lower side panels, which are connected to bottom panels, the carton having side end panels respectively connected to sides of the lower side panels, and top end panels respectively connected to sides of the top panel, and the bottom panels capable of being folded into a closed position, the top end panels capable of being respectively closed by two-piece webs, the webs being respectively connected by fold lines to the sloping upper side panels and the side end panels, and each web including a tuck-in panel, a gusset panel, and a nick, wherein for each web the nick is formed between the tuck-in panel and the respective side end panel, the nicks being capable of respectively pulling the tuck-in panels inward during formation of the carton, the method comprising:

securing the bottom panels together to form a sleeve;

closing the side end panels, wherein the nicks respectively pull the gusset panels inwardly; and securing the top end panels to the side end panels.

2. The method of claim 1, wherein openings are respectively provided between the sloping upper side panels and the respective two piece webs to facilitate folding.

3. A carton comprising:

a top panel;

upper side panels connected to the top panel;

lower side panels respectively connected to the upper side panels at respective lateral fold lines, wherein the lower side panels extend between opposite ends of the carton;

at least one bottom panel connected to at least one of the lower side panels;

side end panels respectively connected to sides of the lower side panels at respective longitudinal fold lines, wherein the side end panels respectively extend at least partially across the ends of the carton;

top end panels respectively connected to sides of the top panel; and webs respectively connected to the top end panels by fold lines, wherein each web includes a tuck-in panel, a gusset panel, and a nick, the tuck-in panels are respectively adjacent the side end panels, for each web, the nick of the web is formed between the tuck-in panel of the web and the side end panel that is adjacent to the web, and for each web, the nick of the web comprises a space between the tuck-in panel of the web and the side end panel that is adjacent the web, the space includes carton material that is substantially free from fold lines or other lines of weakening, the nicks are operative for respectively pulling the tuck-in panels inwardly during formation of the carton, and each nick is proximate both a respective lateral fold line of the lateral fold lines and a respective longitudinal fold line of the longitudinal fold lines.

4. The carton according to claim 3 wherein the respective lateral fold line and the respective longitudinal fold line intersect and a portion of the respective lateral fold line extends laterally beyond the intersection to a lateral end thereof, the space of each nick being between the lateral end of the respective lateral fold line and the outer periphery of the carton.

5. The carton according to claim 3 further comprising an opening between a respective upper side panel and the respective web to facilitate folding.

6. The carton according to claim 3 wherein the at least one bottom panel comprises two bottom panels folded into a closed position, each of the two bottom panels being respectively connected to one of the lower side panels.

7. The carton according to claim 3 further comprising a plurality of bottles disposed within the carton.

8. The carton according to claim 3 wherein each top end panel includes a foldably connected top end panel flap.

9. A blank for forming a carton, comprising:

a top panel;

upper side panels connected to the top panel;

lower side panels respectively connected to the upper side panels at respective lateral fold lines;

at least one bottom panel connected to at least one of the lower side panels;

top end panels respectively connected to sides of the top panel;

side end panels respectively connected to sides of the lower side panels at respective longitudinal fold lines, the side end panels extending to respective lateral edges positioned further from the center of the blank than respective lateral edges of the top end panels; and webs respectively connected to the top end panels by fold lines, wherein each web includes a tuck-in panel, a gusset panel, and a nick, the tuck-in panels are respectively adjacent the side end panels, for each web, the nick of the web is formed between the tuck-in panel of the web and the side end panel that is adjacent to the web, and for each web, the nick of the web comprises a space between the tuck-in panel of the web and the side end panel that is adjacent the web, the space includes carton material that is substantially free from fold lines or other lines of weakening, the nicks are operative for respectively pulling the tuck-in panels inwardly during formation of the blank into the carton, and each nick is proximate both a respective lateral fold line of the lateral fold lines and a respective longitudinal fold line of the longitudinal fold lines.

10. The blank according to claim 9 wherein the respective lateral fold line and the respective longitudinal fold line intersect and a portion of the respective lateral fold line extends laterally beyond the intersection to a lateral end thereof; the space of each nick being between the lateral end of a respective lateral fold line and the outer periphery of the carton.

11. The blank according to claim 9 further comprising an opening between the respective upper side panel and a respective web to facilitate folding.

12. The blank according to claim 9 wherein the at least one bottom panel comprises two bottom panels folded into a closed position, each of the two bottom panels being respectively connected to one of the lower side panels.

13. The blank according to claim 9 wherein each top end panel includes a foldably connected top end panel flap.

14. A method of forming a carton from a blank, comprising:

providing a blank comprising: a top panel; upper side panels connected to the top panel; lower side panels connected to the upper side panels at respective lateral fold lines; at least one bottom panel connected to at least one of the lower side panels; side end panels respectively connected to the lower side panels at respective longitudinal fold lines; top end panels respectively connected to sides of the top panel, and webs respectively connected to the top end panels by fold lines, wherein each web includes a tuck-in panel, a gusset panel, and a nick, the tuck-in panels are respectively adjacent the side end panels, for each web, the nick of the web is formed between the tuck-in panel of the web and the side end panel that is adjacent to the web, the nicks are operative for respectively pulling the tuck-in panels inwardly during formation of the blank into the carton, and each nick is proximate both a respective lateral fold line of the lateral fold lines and a respective longitudinal fold line of the longitudinal fold lines;

securing the at least one bottom panel to form a sleeve;

closing the side end panels; and securing the top end panels to the side end panels.

15. The method according to claim 14, wherein an opening is provided between each upper side panel and the respective web.

16. The method according to claim 14, wherein the at least one bottom panel comprises two bottom panels, and wherein securing the at least one bottom panel comprises folding the bottom panels into a closed position and securing the bottom panels together.

17. The method according to claim 14, further comprising enclosing a plurality of bottles within the sleeve.

* * * * *